US007275478B2

(12) United States Patent
Ikuta

(10) Patent No.: US 7,275,478 B2
(45) Date of Patent: Oct. 2, 2007

(54) HIGH-SPEED FLUID SORTING AND CHARGING DEVICE

(75) Inventor: Kazumasu Ikuta, Yokohama (JP)

(73) Assignee: Bay City Service Ltd., Kanagawa (JP)

( * ) Notice: Subject to any disclaimer, the term of this patent is extended or adjusted under 35 U.S.C. 154(b) by 736 days.

(21) Appl. No.: 10/486,027

(22) PCT Filed: Aug. 5, 2002

(86) PCT No.: PCT/JP02/07981

§ 371 (c)(1),
(2), (4) Date: Feb. 5, 2004

(87) PCT Pub. No.: WO03/031265

PCT Pub. Date: Apr. 17, 2003

(65) Prior Publication Data

US 2004/0231525 A1 Nov. 25, 2004

(30) Foreign Application Priority Data

Aug. 6, 2001 (JP) ..... 2001-237572
Nov. 5, 2001 (JP) ..... 2001-338915

(51) Int. Cl.
*A23L 1/00* (2006.01)

(52) U.S. Cl. ..... 99/348; 99/352

(58) Field of Classification Search ..... 99/331–334, 99/342–344, 352–355, 357, 467, 468, 473–476, 99/483, 348; 366/145–147, 196, 183; 222/54, 222/64, 105, 183, 146.5, 235, 443; 221/92, 221/101, 150 A, 150 HC, 203; 426/587, 426/578, 661

See application file for complete search history.

(56) References Cited

U.S. PATENT DOCUMENTS 3,638,557 A * 2/1972 Ljung ..... 99/348
4,357,111 A * 11/1982 Honemeyer et al. ..... 366/145
5,363,747 A * 11/1994 Clark et al. ..... 99/348
6,006,657 A * 12/1999 Ikuta ..... 99/331
6,513,421 B2 * 2/2003 Ikuta ..... 99/348

FOREIGN PATENT DOCUMENTS

JP 111539/1973 12/1973
JP 51-14477 2/1976
JP 2000-226100 8/2000
JP 2001-29049 2/2001

* cited by examiner

*Primary Examiner*—Timothy F. Simone
(74) *Attorney, Agent, or Firm*—Jordan and Hamburg LLP

(57) ABSTRACT

A high speed subdividing and filling apparatus for liquid food containing solids therein comprising: a fixed quantity cut-down pump body having an absorption opening in communication with a lower-end opening of a liquid food accommodating container and having a discharge opening; an inner cylinder turnably fitted in the fixed quantity cut-down pump body; a piston slidably fitted in the inner cylinder; and a through-hole formed in the inner cylinder, wherein rotation of the inner cylinder and forward/backward movement of the piston are coupled so as the through-hole of the inner cylinder is communicated with the absorption opening of the cut-down pump body, the piston moves back to fill liquid food into the inner cylinder and as the through-hole of the inner cylinder is communicated with the discharge opening of the pump body, the piston advances to discharge liquid food from the discharge opening.

9 Claims, 5 Drawing Sheets

HIGH-SPEED FLUID SORTING AND CHARGING DEVICE

TECHNICAL FIELD

This invention relates to a high-speed subdividing and filling apparatus for use of filling, into canned food or a vacuum-pack bag, ingredients-contained soup or the like such as curry, minestrone, pork juice, stew, and so on, or for use of subdividing by a fixed quantity.

BACKGROUND ART

Conventionally, filling a can with ingredients-contained soup or the like such as curry, minestrone, pork juice, stew, and so on, in which meat, or vegetables are mixed into liquid, to make canned food, and filling a vacuum-pack bag with them have been carried out by two steps, i.e., one step of filling ingredients and the other step of filling soup.

FIG. 1 shows a conventional filling apparatus. An operator takes a fixed quantity of ingredients out of a container of ingredients and puts them into a can, after which the can filled with ingredients is moved to a conveyor, and a fixed quantity of soup liquid is filled into the can from a filling apparatus.

Filling the soup liquid is carried out by taking in a fixed quantity of soup liquid through a check valve by a piston pump from a soup container, and pouring it into the can filled with ingredients through the check valve. This method has a problem such that since a container or can in which ingredients are received is open, foreign matter such as an insect or bug is possibly mixed in or soup or the like becomes air-oxidized. In addition, there is a further problem in that since work is carried out by the two steps, the work efficiency is poor.

No problem occurs if both the ingredients and soup liquid can be filled into the can together. However, if doing so, it cannot be subdivided into soup or the like containing a fixed quantity of ingredients, resulting in clogging of ingredients in the check valve to lead to trouble of the apparatus. Therefore, work has been carried out by the two steps as described above.

This invention is intended to solve the problems as noted above. An object of the invention is to provide a subdividing and filling apparatus for liquid food capable of subdividing and filling ingredients and soup liquid together at a high speed.

It is a further object of the invention to provide a subdividing and filling apparatus entirely free from occurrence of troubles such that ingredients are caught in the rotary valve.

DISCLOSURE OF THE INVENTION

The invention according to claim 1 out of the inventions in compliance with the above-described objects comprises a fixed quantity cut-down pump body having an absorption opening in communication with an lower-end opening of a liquid food accommodating container for subdividing and filling and a discharge opening to a subdividing and filling container, an inner cylinder turnably fitted in the fixed quantity cut-down pump body, a piston slidably fitted in the inner cylinder, and a through-hole formed in the inner cylinder, wherein rotation of the inner cylinder and advance/backward movement of the piston are coupled so that the through-hole of the inner cylinder is communicated with the absorption opening of the fixed quantity cut-down pump body, the piston moves back to fill a fixed quantity of liquid food into the inner cylinder whereas when the through-hole of the inner cylinder is communicated with the discharge opening of the apparatus body, the piston advances to discharge liquid food from the discharge opening communicated.

At least one side opposite the rotational direction of the through-hole of the inner cylinder is formed to be a cutting edge, whatever the ingredients may be can be cut when the absorption opening is closed by the inner cylinder.

The side of the absorption opening which comes in contact with the cutting edge so as to be crossed is preferably formed of steel or metal having a part like steel.

The fixed quantity cut-down pump body will suffice if the inner cylinder may be fitted turnably, but an outer cylinder or a block body having a fitting hole is preferable.

The absorption opening and the discharge opening of the fixed quantity cut-down pump body that can be communicated with the through-hole of the inner cylinder are preferably formed at an opposed position.

For coupling the rotation of the inner cylinder to the advance and backward movement of the piston, preferably, an end of the inner cylinder is connected or formed in a first gear, the first gear is meshed with a second gear secured to a rotational shaft of a motor, and a crank shaft for reciprocating a piston shaft of a piston is fixed through a rotary body which rotates along with the rotary shaft of the motor.

Preferably, the number of teeth of the first gear is made to be the same as that of the second gear so that both the gears are meshed at a right angle, and when the inner cylinder rotated once, the piston shaft is reciprocated once.

If the fixing position of the crank shaft to the rotary body is made variable, the filling quantity of liquid food into the inner cylinder can be changed.

Even if liquid food is ingredients-contained soup or the like, if it is subdivided and filled when the advance/backward movement operation of the piston is carried out in the state free from in-flow/discharge of air, while stirring it by stirring blades within a container, that can be subdivided into soup or the like containing nearly a fixed quantity of ingredients.

When the ingredients-contained soup or the like are heated, the stirring blades are pressed upward for stirring, and when subdividing and filling, they are pressed downward for stirring, whereby a mixing quantity of ingredients can be always made even. This can be achieved by the arrangement such that the stirring blades are rotated in opposition depending upon heating or subdividing.

BEST MODE FOR CARRYING OUT THE INVENTION

The embodiments of the present invention will be described hereinafter with reference to the accompanying drawings.

Figure 1:
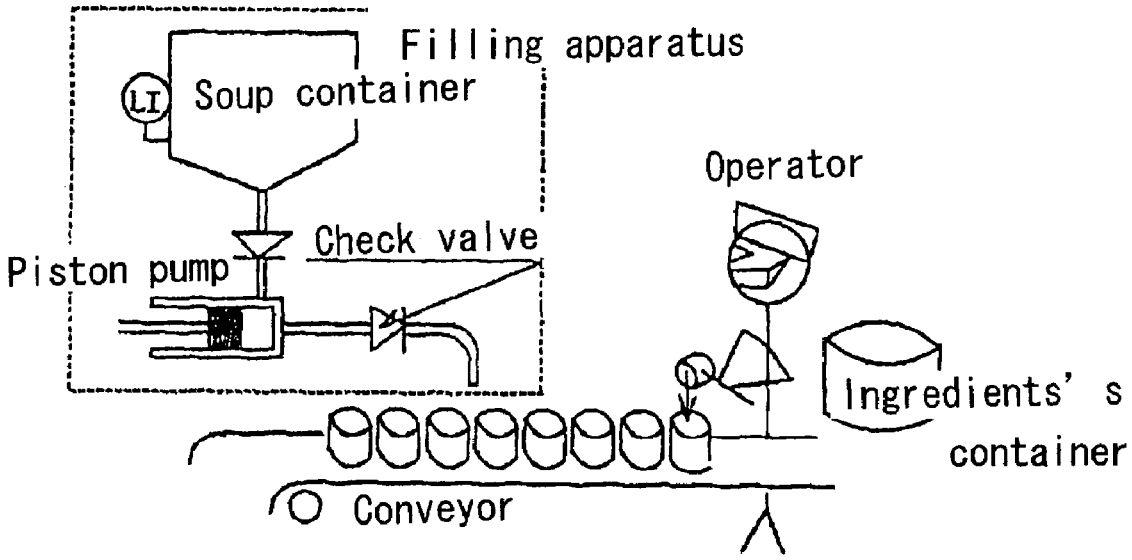
FIG. 1 is a schematic sectional view showing a conventional subdividing and filling apparatus.
Figure 2:
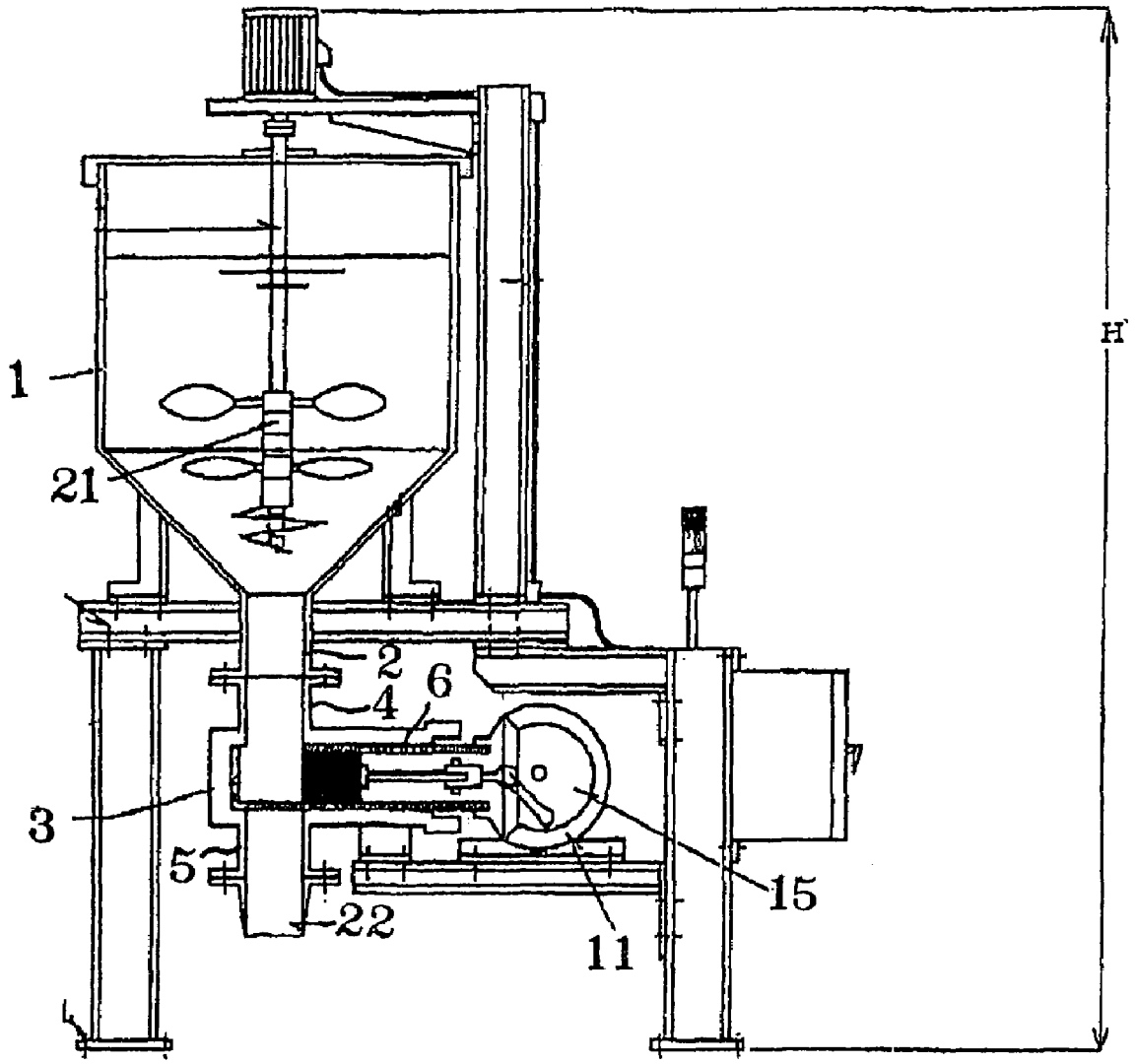
FIG. 2 is a sectional view showing one embodiment of the present invention.

As shown in FIG. 2, a fixed quantity cut-down pump body 3 is connected and secured to a lower-end opening 2 of a hopper-like container 1 receiving therein ingredients-contained soup or the like to be subdivided and filled. The fixed quantity cut-down pump body 3 is formed into a tubular body having an extreme end closed, and both flanges of an upper-end opening (an absorption opening) 4 of the cut-down pump body and the lower-end opening 2 of a container are connected by bolts.

At the lower end of the fixed quantity cut-down pump body 3, a lower-end opening (a discharge opening) 5 is formed opposite the upper-end opening 4. A filling nozzle 22 is connected to the discharge opening 5, as shown in FIG. 2. The filling nozzle 22 can be exchanged with a nozzle for various canned food and a nozzle for a vacuum pack.

Figure 3:
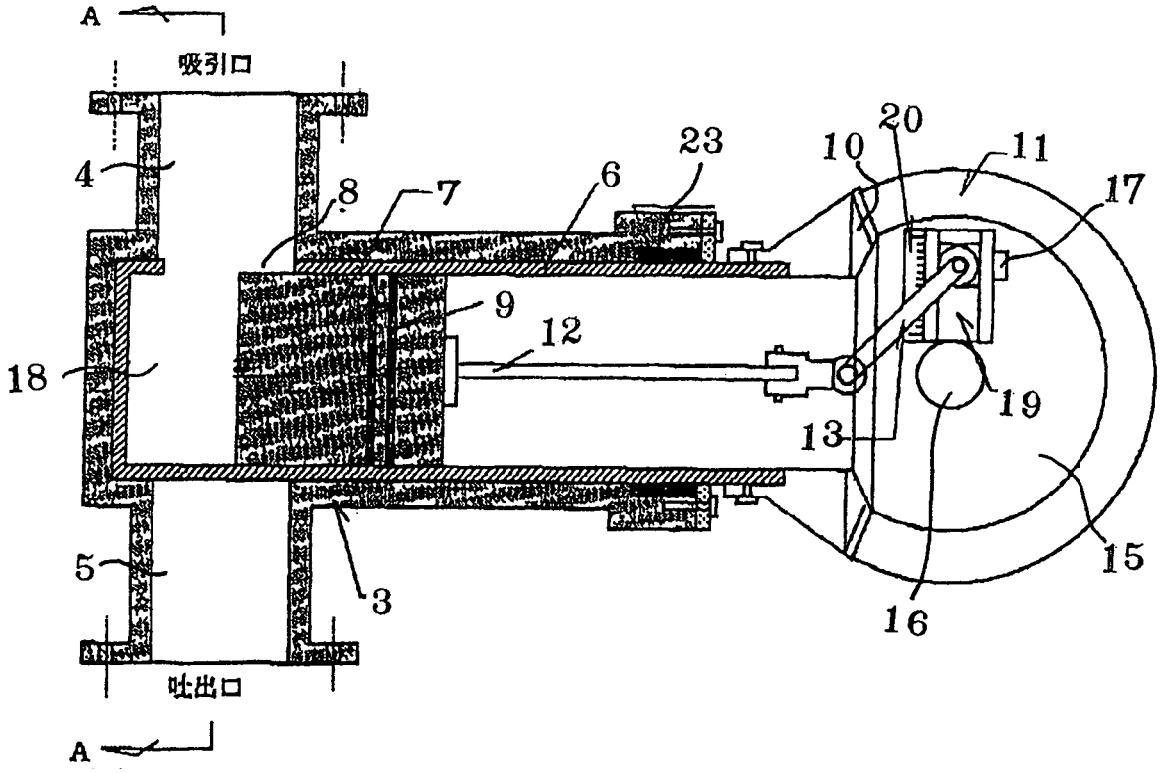
FIG. 3 is a sectional view showing one embodiment of a cut-down valve of the present invention.

As shown in FIGS. 2 and 3, an inner cylinder (a fixed quantity tubular body) 6 is turnably fitted in the fixed quantity cut-down pump body 3.In a recessed groove in the inner circumferential surface at the rear end of the fixed quantity cut-down pump body 3 is mounted a ring-like seal member 23 to enhance the sealing property between the inner cylinder 6 and the fixed quantity cut-down pump body 3.

A piston body 7 is slidably fitted within the inner cylinder 6. A piston ring 9 is fitted and mounted in the outer circumference of the piston body 7 in order to enhance the air-tightness.

A through-hole 8 is formed in the inner cylinder 6. When the through-hole 8 is communicated with the absorption hole 4 of the fixed quantity cut-down pump body 3, the piston body 7 moves back to fill a fixed quantity of the ingredients-contained soup or the like into the inner cylinder 6, whereas when the through-hole 8 of the inner cylinder 6 is communicated with the discharge opening 5 of the fixed quantity cut-down pump body 3, the piston body 7 advances to discharge the ingredients-contained soup or the like from the discharge hole 5 communicated.

A first gear (a bevel gear) 10 is provided at the end of the inner cylinder 6, and the first gear 10 is meshed at a right angle with a second gear (a bevel gear) 11 secured to a rotary shaft 16 of a motor. A crank shaft 13 for reciprocating the piston body 7 through a piston shaft 12 is secured to a rotary body 15 secured to the rotary shaft 16 of a motor. Since the first gear 10 and the second gear 11 have the same number of teeth, when the inner cylinder rotates once, the piston body 7 reciprocates once.

The crank shaft 13 is secured to the rotary body 15. The piston body 7 is reciprocated by rotation of the rotary body 15, and when the rotary body 15 rotates once, the piston shaft 12 reciprocates once, and the inner cylinder 6 rotates once. Since the crank shaft 13 may be rotated together with the second gear 11, a gear meshed with the second gear 11 may be provided and secured to the aforesaid gear.

A fixed position of the crank shaft 13 is varied between the center of the rotary body 15 and outer circle direction by a stroke adjusting screw 17, whereby an area of a fixed quantity filling chamber within the inner cylinder 6 can be changed, and the quantity of soup of the like to be subdivided and filled can be changed. In the drawing, numeral 19 denotes a stroke adjusting mechanism, and a numeral 20 denotes a filling quantity graduation.

As shown in FIG. 2, a stirring blade 21 for stirring ingredients-contained soup or the like is disposed internally of the container 1, which is formed so that the ingredients-contained soup or the like can be divided and filled in the state that the operation of advance/backward movement of the piston is carried out free from in-flow and discharge air while stirring the ingredients-contained soup or the like by the stirring blade. By forming so, there can be subdivided into soup or the like containing nearly a fixed quantity of ingredients without separating the ingredients from soup.

When the ingredients-contained soup or the like is heated, the stirring blade stirs it so as to press upward, whereas when being subdivided and filled, it stirs so as to press down, whereby the soup can be subdivided into soup or the like containing nearly a fixed quantity of ingredients and filled. For this purpose, the stirring blades may be rotated oppositely depending on the heating or subdividing.

The method of using the apparatus according to the present invention will be described hereinafter.

Figure 4:
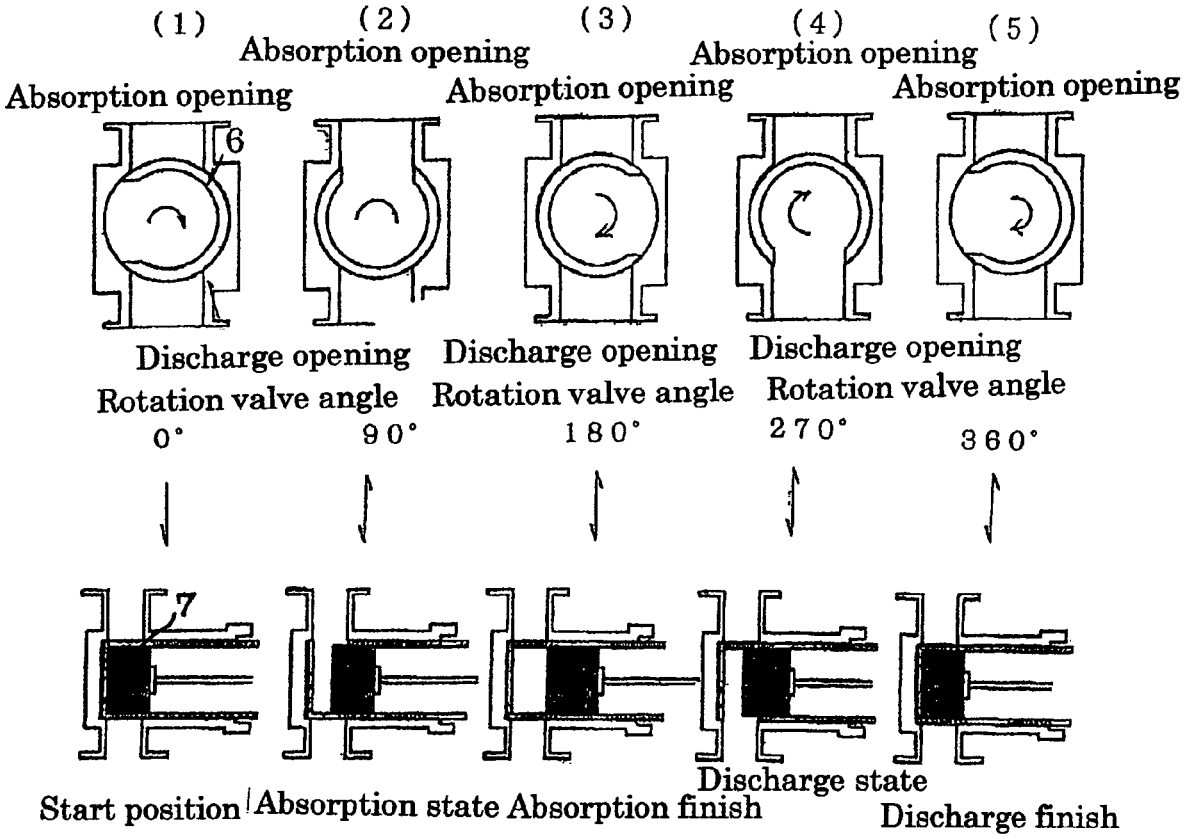
FIG. 4 is an explanatory view of absorption and discharge of soup or the like using the a cut-down valve of the present invention, being a sectional view taken on A-A of FIG. 3.

As shown in FIG. 4(1), the start position is a position at which the piston body 7 is pushed to the extreme end in this figure, and the absorption opening and the discharge opening are closed. There is shown that the absorption opening is in a state of the absorption start.

When the first gear and the second gear rotate 90° and the inner cylinder rotates 90°, the piston body 7 moves back to a position half of a fixed amount in association with the rotation of the inner cylinder 6, as shown in FIG. 4(2) to assume a state in which the ingredients and soup are drawn half into the inner cylinder 6. In this state, the absorption opening is completely communicated with the through-hole 8 of the inner cylinder, but is closed half by the piston body 7.

When the inner cylinder 6 further rotates 90° (180° rotated position), the piston body 7 assumes a position drawn to the rear end in association with the rotation of the inner cylinder 6, as shown in FIG. 4(3), assuming a state that the ingredients and soup liquid are completely drawn a fixed quantity. This position is an instantaneous switching position between the advance and the backward movement (absorption and discharge) of the piston body. This shows that the discharge opening is in a state of the discharge start.

When the inner cylinder 6 further rotates 90° (270° rotated position), the piston body 7 assumes a position pushed half in association with the rotation of the inner cylinder 6, as shown in FIG. 4(4), assuming a state that the ingredients and soup liquid are discharge half. The discharge opening is completely communicated with the through-hole 8, but is closed half by the piston body 7.

When the inner cylinder further rotates 90° (360° rotated position), the piston body 7 assumes a position pushed completely in association with the rotation of the inner cylinder, as shown in FIG. 4(5), and returns to the initial start position at which the ingredients and soup liquid are completely discharged, thus completing one cycle. This state is an instantaneous switching position between the advance and the backward movement (absorption and discharge) of the piston body 7. Within the one cycle, no air flows into a cut-down valve (also called a rotary valve or a fixed quantity cut-down pump), and in the operation of the advance/backward movement of the piston body 7, the state of absence of inflow/discharge of air is maintained.

In the above-described one cycle, the first gear 10 and the second gear 11 rotate once, and the piston shaft 12 reciprocates once. Accordingly, the rotational speed of the motor is made high whereby the subdividing and filling can be done at an extremely high speed. The high-speed subdividing and filling 60 to 120 times a hour can be accomplished by the adjustment of rotational speed.

Figure 5:
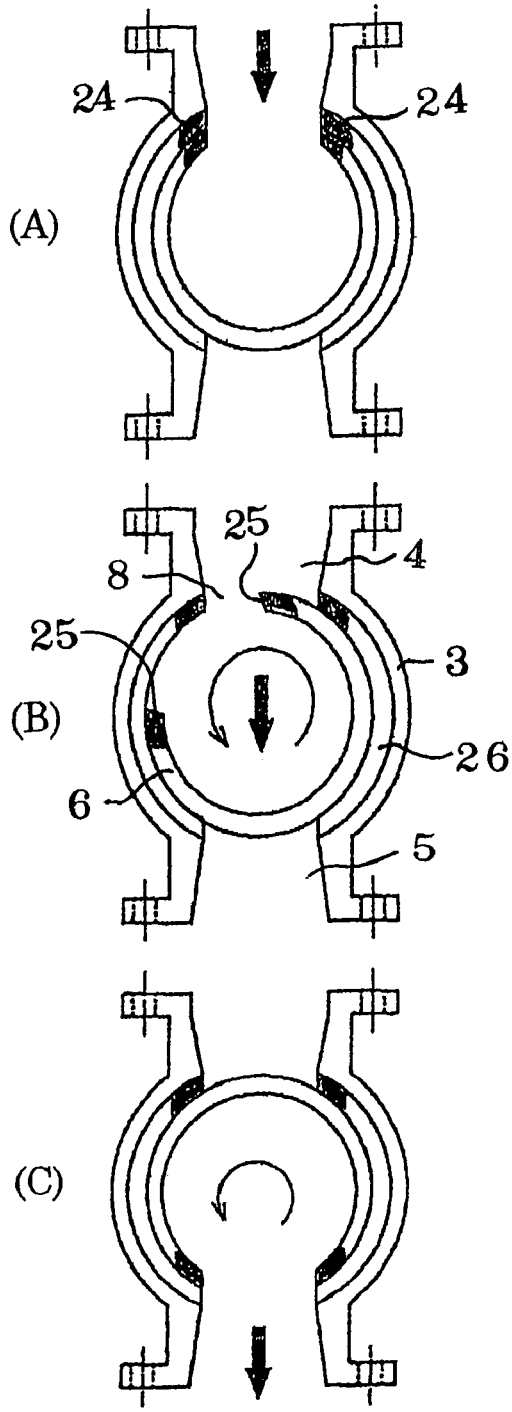
FIG. 5 is a sectional view showing another embodiment of the present invention.

FIG. 5 shows another embodiment of the present invention. Both sides opposite the rotational direction of the opening (through-hole) 8 of the inner cylinder 6 are formed into cutting edges 25, 25. Only one side out of opposed both sides may be the cutting edge 25, but if both of them are made to be cutting edges as described, even if one of them is not adapted to be cut, they may be rotated oppositely to use the other for cutting, thus extending the service life of the cutting edge 25, which is preferable.

Steel or metals 24, 24 having a part like steel are secured to the opposed both sides of the upper-end opening (absorption opening) 4 in contact with the cutting edge 25. Where only one side of the opening is made to be the cutting edge 25, only the side in contact with the cutting edge 25 so as to be crossed may be formed of steel or metal having a part like steel. In the embodiment shown in FIG. 5, the inner cylinder 6 is turnably fitted in a cylindrical opening of the fixed quantity cut-down pump body 3 through a cylindrical stainless steel 26, and sterite weld (sterite build) parts 24, 24 are formed on opposed both sides of the upper-end opening of the cylindrical stainless steel 26 so as to have a part like steel.

Subdividing soup or the like using a rotary valve as shown in FIG. 5 may be carried out by putting ingredients-contained soup or the like into the hopper of FIG. 2, disposing stirring blades within the hopper, moving back the piston to a fixed position as shown in FIGS. 5(A) and (B) while stirring the ingredients-contained soup or the like, receiving a fixed quantity of ingredients-contained soup or the like into the inner cylinder 6, rotating the inner cylinder 6 as shown in FIG. 5(C) to advance the piston, and discharging it from the discharge part (discharge opening). By doing so, even where large ingredients are mixed in, they can be cut easily, thus avoiding the problem where the ingredients are caught by the rotary valve.

A discharge quantity of ingredients-contained soup or the like to be subdivided and filled is not particularly limited, but the quantity of 100 cc at minimum to 300 cc at maximum is preferred. In the apparatuses according to the embodiments shown in the drawings of the present invention, the adjustment of the discharge quantity can be made by the stroke adjusting mechanism 19.

The apparatus of the present invention can be used for whatever use may be as long as its object is to subdivide and fill soup or the like, preferably, ingredients-contained soup or the lie. For example, the apparatus can be used for the purpose of subdividing and filling by a fixed quantity, for example, into a can, a bottle or a bag, or subdividing person by person to offer it to clients.

Further, if the rotary valve of the present invention is used to subdivide ingredients-contained soup or the like, even if ingredients that clog the rotary valve are mixed in, that can be cut, thus occurring no trouble at all that the ingredients are caught by the rotary valve.

INDUSTRIAL APPLICABILITY

According to the present invention, since the rotation of the inner cylinder and the advance/backward movement of the piston are coupled, the soup or the like can be subdivided and filled at an extremely high speed, thus enhancing the work efficiency with rapid progress as compared with prior art. Moreover, since subdividing and filling can be carried out in the state free from inflow/discharge of air, possible air oxidization and possible mixing of an insect or the like are reduced remarkably. Therefore, it is expected that the apparatus is widely spread as a subdividing apparatus for ingredients-contained soup or the like in a Chinese restaurant or other restaurants.

What is claimed is:

1. A subdividing and filling apparatus for liquid food comprising:

a fixed quantity cut-down pump body having an absorption opening in communication with a lower-end opening of a container for accommodating liquid food containing solids therein and a discharge opening for discharging therefrom the liquid food containing solids;

an inner cylinder turnably fitted in the fixed quantity cut-down pump body;

a piston slidably fitted in the inner cylinder; and a through-hole formed in the inner cylinder, wherein rotation of the inner cylinder and forward/backward movement of the piston are coupled so as the through-hole of the inner cylinder is communicated with the absorption opening of the fixed quantity cut-down pump body, the piston moves back to fill a fixed quantity of liquid food into the inner cylinder, and as the through-hole of the inner cylinder is communicated with the discharge opening of the pump body, the piston advances to discharge liquid food from the discharge opening, and at least one edge of said inner cylinder opposite the rotational direction of said through-hole is formed to be a cutting edge.

2. The apparatus according to claim 1, wherein a side of said absorption opening is in contact with said cutting edge and is traversed by said inner cylinder during said rotation of said inner cylinder and said side comprises steel or other hard metal.

3. The apparatus according to claim 1, wherein said fixed quantity cut-down pump body is an outer cylinder or a block body having a fitting hole.

4. The apparatus according to claim 1, wherein the absorption opening and the discharge opening of said fixed quantity cut-down pump body that can be communicated with the through-hole of said inner cylinder are formed at opposite positions.

5. The apparatus according to claim 1, wherein an end of said inner cylinder is connected to or formed in a first gear, said first gear being meshed with a second gear secured to a rotary shaft of a motor, and a crank shaft for reciprocating a piston shaft of said piston is fixed to a rotary body which rotates together with said rotary shaft of said motor whereby rotation of said inner cylinder and forward/backward movement of said piston are coupled.

6. The apparatus according to claim 5, wherein the number of teeth of said first gear is made to be the same as said second gear so that both gears are meshed at a right angle and when said inner cylinder rotates once, said piston shaft reciprocates once.

7. The apparatus according to claim 6, wherein the position of said crank shaft to said rotary body is made variable so that the filling quantity of said liquid food into said inner cylinder can be varied.

8. The apparatus according to claim 1, wherein said liquid food is subdivided while stirring it with a stirring blade within said liquid food accommodating container such that operation of the forward/backward movement of said piston is carried out free from inflow and discharge of air.

9. The apparatus according to claim 8, wherein said stirring blade stirs so as to push upward when said liquid food is heated, whereas it stirs so as to push downward when said liquid food is subdivided.

* * * * *